US005551360A

United States Patent [19]

Qui

[11] Patent Number: 5,551,360

[45] Date of Patent: Sep. 3, 1996

[54] VIBRATION CONTROL DEVICE FOR SEWING MACHINE

[75] Inventor: Zhongqi Qui, Nagoya, Japan

[73] Assignee: Brother Kogyo Kabushiki Kaisha, Nagoya, Japan

[21] Appl. No.: 497,986

[22] Filed: Jul. 3, 1995

[30] Foreign Application Priority Data

Feb. 3, 1994 [JP] Japan ..... 6-11569
Jul. 27, 1994 [JP] Japan ..... 6-175309

[51] Int. Cl.[6] ..... D05B 19/00

[52] U.S. Cl. ..... 112/470.01; 112/220; 112/258

[58] Field of Search ..... 112/470.01, 220, 112/235, 270, 277, 258, 260; 366/127

[56] References Cited

U.S. PATENT DOCUMENTS 4,869,187 9/1989 Little et al. ..... 112/235 X
5,146,861 9/1992 Sato et al. ..... 112/220 X

FOREIGN PATENT DOCUMENTS 06-304374 11/1994 Japan .

*Primary Examiner*—Peter Nerbun
*Attorney, Agent, or Firm*—Oliff & Berridge

[57] ABSTRACT

A vibration control device for a sewing machine capable of actively reducing the vibration generated on a bed of the sewing machine by the rotation of an arm shaft, the vertical reciprocation of a needle bar, and other vibration inducing movement without reducing a mechanical strength of the sewing machine and adopting any complex designs. The vibration control device includes a sync signal generating device for generating a sync signal in synchronism with rotation of the arm shaft, a vibration sensor for detecting vibration generated on the bed, a control unit for setting a transfer function, and a piezoelectric actuator for generating control vibration. A control signal interfering with the vibration detected by the vibration sensor is generated by the control unit so as to minimize a detection signal from the vibration sensor according to the sync signal, the detection signal, and the transfer function. Then, the piezoelectric actuator is operated according to the control signal to thereby generate the control vibration, thus actively reducing the detected vibration.

20 Claims, 11 Drawing Sheets

VIBRATION CONTROL DEVICE FOR SEWING MACHINE

BACKGROUND OF THE INVENTION

1. Field of the Invention

The invention relates to a vibration control device for a sewing machine designed to actively reduce vibration generated in a machine body by the rotation of an arm shaft, vertical reciprocation of a needle bar, and similar movements.

2. Description of the Related Art

Conventionally, various techniques of suppressing the generation of vibration in a sewing machine have been provided. Some typical techniques will be described with reference to FIG. 11, showing the internal structure of a machine body of a sewing machine in the prior art.

In a first technique, the total mass of a needle bar 940 and a needle bar connecting stud 946, that vertically reciprocates together with the needle bar 940, is reduced to thereby reduce the vibration generated by the vertical reciprocation of the needle bar 940. For example, the material of the needle bar 940 is changed from a steel material in the form of solid round bar to an aluminum material in the form of hollow bar, thereby reducing the mass of the needle bar 940.

In a second technique, the vibration generated by the vertical reciprocation of the needle bar 940, the vibration generated by the swing motion of a thread take-up lever 936, and the vibration generated by the motion of other parts associated with the needle bar 940 and the thread take-up lever 936 are intended to be canceled by the vibration generated by the rotation of a thread take-up crank 934 associated with the needle bar 940 and the thread take-up lever 936. The material, size, and location of each part are determined so as to reduce the vibration.

In a third technique, the wall thickness of an arm 922 is increased to increase the rigidity of the arm 922, thereby suppressing the generation of vibration.

In a fourth technique, there is provided a simple device for generating a waveform with a phase that is reversed to that of the vibration generated by vertical reciprocation of the needle bar 940 to suppress the vibration of the sewing machine.

However, in the first technique, the mechanical strength of the mechanism as a whole is reduced. Therefore, to limit the reduction in mechanical strength, the reduction of the mass is limited and the reduction in vibration is accordingly limited.

In the second technique, the needle bar 940, the thread take-up lever 936, and the other parts, including the thread take-up crank 934 moving in association with the parts 940,936, produce complex mutual motions which are high-speed motions. Therefore, it is very difficult to design all the parts sufficiently in balance so as to reduce the vibration.

In the third technique, a cost of parts is increased. Further, the increase in rigidity of the arm 922 causes an increase in the total weight of the sewing machine, departing from an intention of the design to reduce the weight of the sewing machine and thereby facilitate handling by an operator.

Finally in the fourth technique, it is very difficult to precisely attain a waveform with the same amplitude and the reverse phase to the vibration caused by the high-speed rotation of the arm shaft 931 of the sewing machine. Further, in actuality, the vibration of the sewing machine suffers from an influence of the disturbance, and the time delay in the vibration transfer system, as well as other equally complex considerations. Therefore, it is considered impossible to accurately track and suppress the vibration.

SUMMARY OF THE INVENTION

An object of the invention is to provide a vibration control device for a sewing machine which can actively reduce the vibration generated in a machine body of the sewing machine by rotation of the arm shaft, the vertical reciprocation of a needle bar, and similar high speed movements without reducing the mechanical strength of the sewing machine and/or adopting a complex design.

To achieve the above object, the vibration control device for the sewing machine of the invention comprises sync signal generating means for generating a sync signal in synchronism with rotation of an arm shaft of the sewing machine; vibration detecting means for detecting vibration generated in a machine body of the sewing machine by the rotation of the arm shaft, vertical reciprocation of a needle bar, and other factors; control vibration generating means capable of generating a control vibration for canceling the vibration generated in the machine body; transfer function setting means for preliminarily setting a transfer function indicative of characteristics of the mechanical parts and control the electrical parts of the sewing machine; and vibration control means for controlling the control vibration generating means so as to minimize the vibration detected by the vibration detecting means according to the sync signal generated from the sync signal generating means, the transfer function set by the transfer function setting means, and a detection signal from the vibration detecting means.

According to the vibration control device for the sewing machine of the invention, having the above structure, when the sewing machine is operated, a sync signal is generated from the sync signal generating means, and vibration generated in the machine body by rotation of the arm shaft, vertical reciprocation of the needle bar, and similar movements is detected by the vibration detecting means. The vibration control means controls the control vibration generating means so as to minimize the vibration detected by the vibration detecting means according to the sync signal, the detection signal from the vibration detecting means, and the transfer function set by the transfer function setting means so that the control vibration generated from the control vibration generating means acts to cancel the vibration generated on the machine body, thus actively reducing the vibration. Further, even when the rotation of the arm shaft is constant and the vibration on the machine body is changed by thermal phenomena, disturbances, or similar factors, the control vibration from the control vibration generating means can reliably track the vibration of such a variable system, thereby reducing the vibration.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

Preferred embodiments of the invention will now be described with reference to the drawings.

Figure 1:
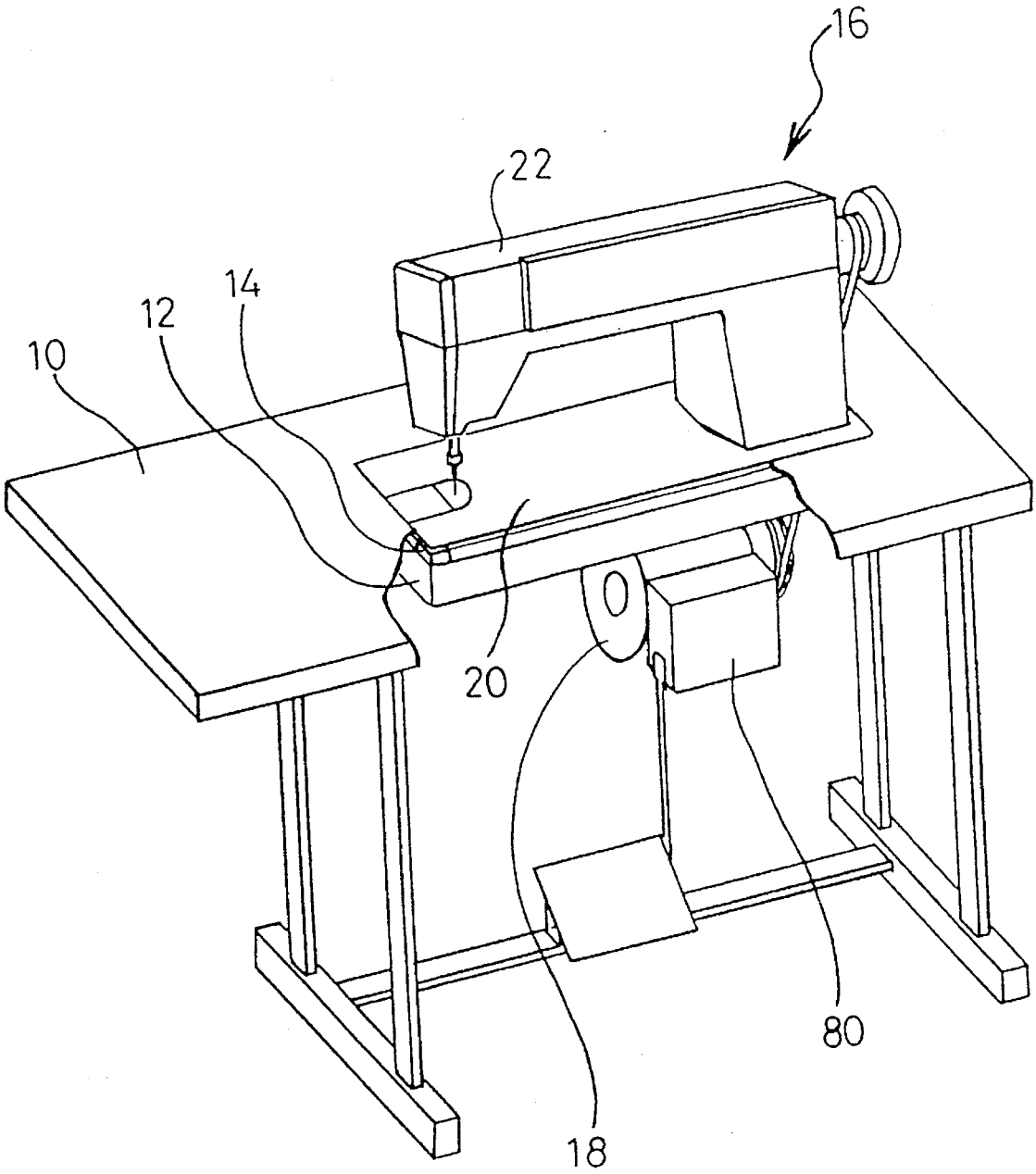
FIG. 1 is a perspective view of a sewing machine in first and second preferred embodiments of the invention.

A first preferred embodiment of the invention will be described with reference to FIG. 1 which shows the appearance of a sewing machine to which the invention is applied. A machine body 16 has a bed 20 as a lower part in contact with an oil pan 12 and an arm 22 as an upper part. The machine body 16 is mounted, through a rubber vibration isolator 14 on the oil pan 12 which is fixed to a table 10, and is driven by a motor 18 fixed under the table 10. A control box 80 is fixed adjacent to the motor 18.

Figure 2:
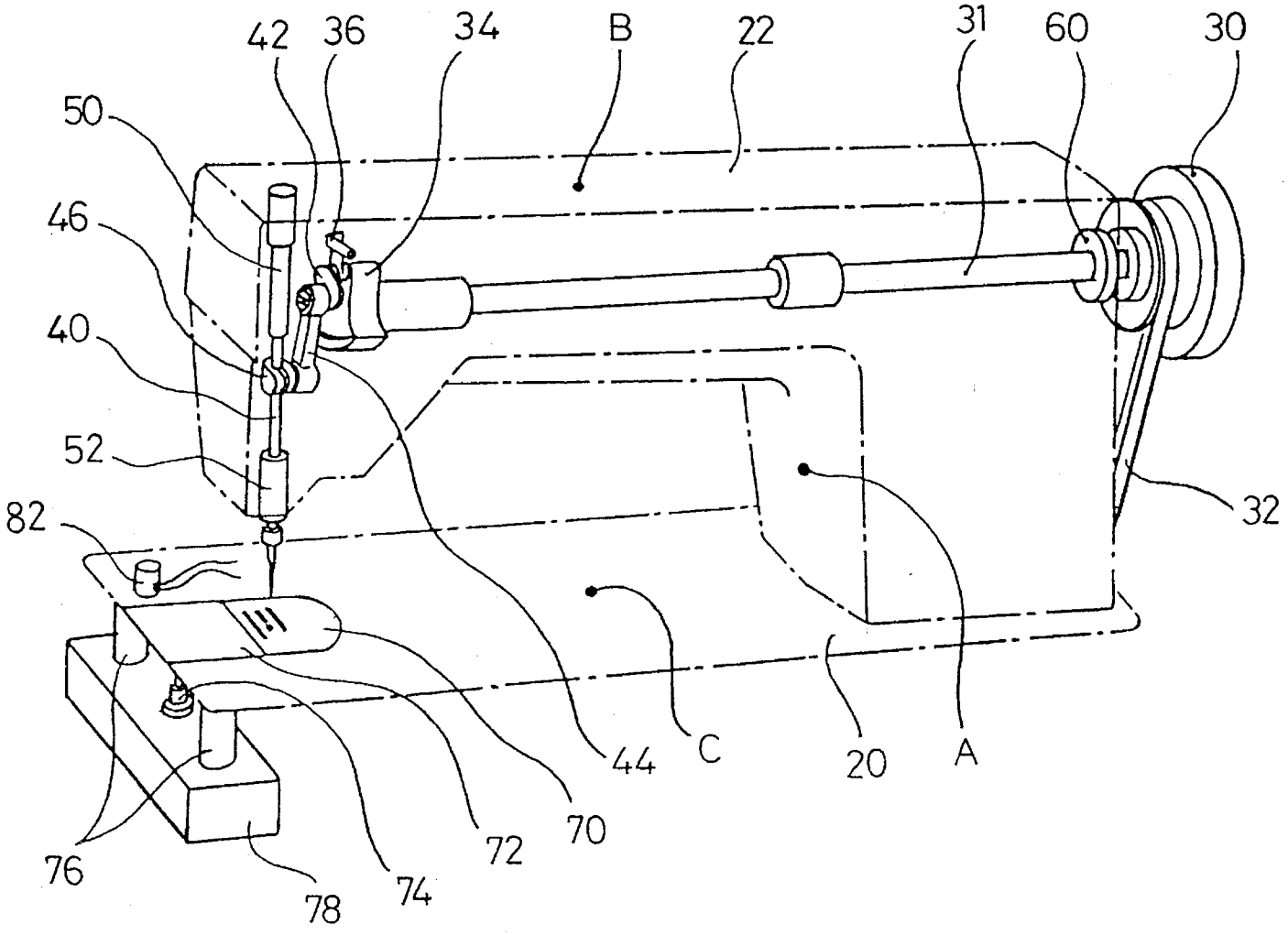
FIG. 2 is a perspective view showing the internal structure of a machine body in the first preferred embodiment.

FIG. 2 shows the internal structure of the machine body 15 and a pulley 30, that is fixed to one end of an arm shaft 31 provided in the arm 22. The pulley 30 and the motor 18, shown in FIG. 1, are connected by a belt 32. The driving force of the motor 18 is transmitted through the belt 32 and the pulley 30 to the arm shaft 31.

A thread take-up crank 34 is fixed to the end of the arm shaft 31, away from pulley 30, and rotates with the rotation of the arm shaft 31. A thread take-up lever 36 is connected to the thread take-up crank 34 and is vertically swung with the rotation of the arm shaft 31. A needle bar 40 is connected through a needle bar crank 42, a needle bar connecting rod 44, and a needle bar connecting stud 46 to the thread take-up lever 36, and is vertically reciprocated with rotation of the arm shaft 31 as guided by an upper needle bar bushing 50 and a lower needle bar bushing 52, both fixed to the arm 22. In the following description, the side of the sewing machine mounting the pulley 30 will be referred to as a right side and the side of the sewing machine mounting the needle bar 40 will be referred to as a left side.

A sync signal generating device 60, for generating a sync signal in synchronism with rotation of the arm shaft 31, is provided on the right end portion of the arm shaft 31. A throat plate 70, a bed slide 72, and a vibration sensor 82, as the vibration detecting means, are provided on the left portion of the bed 20. Under the members 70,72,82, there are provided a piezoelectric actuator 74 as the control vibration generating means, a pair of coil springs 76, and a weight 78. The two springs 76 are fixed at their upper ends to the lower surface of the bed 20 at respective positions to the front and rear of the bed slide 72. The weight 78 is fixed to the lower ends of the two springs 76 and is normally resiliently biased toward the lower surface of the bed 20 by the two springs 76. The piezoelectric actuator 74 is interposed between the lower surface of the bed 20 and the upper surface of the weight 78 under pressure by the tensile forces of the springs 76.

Figure 3:
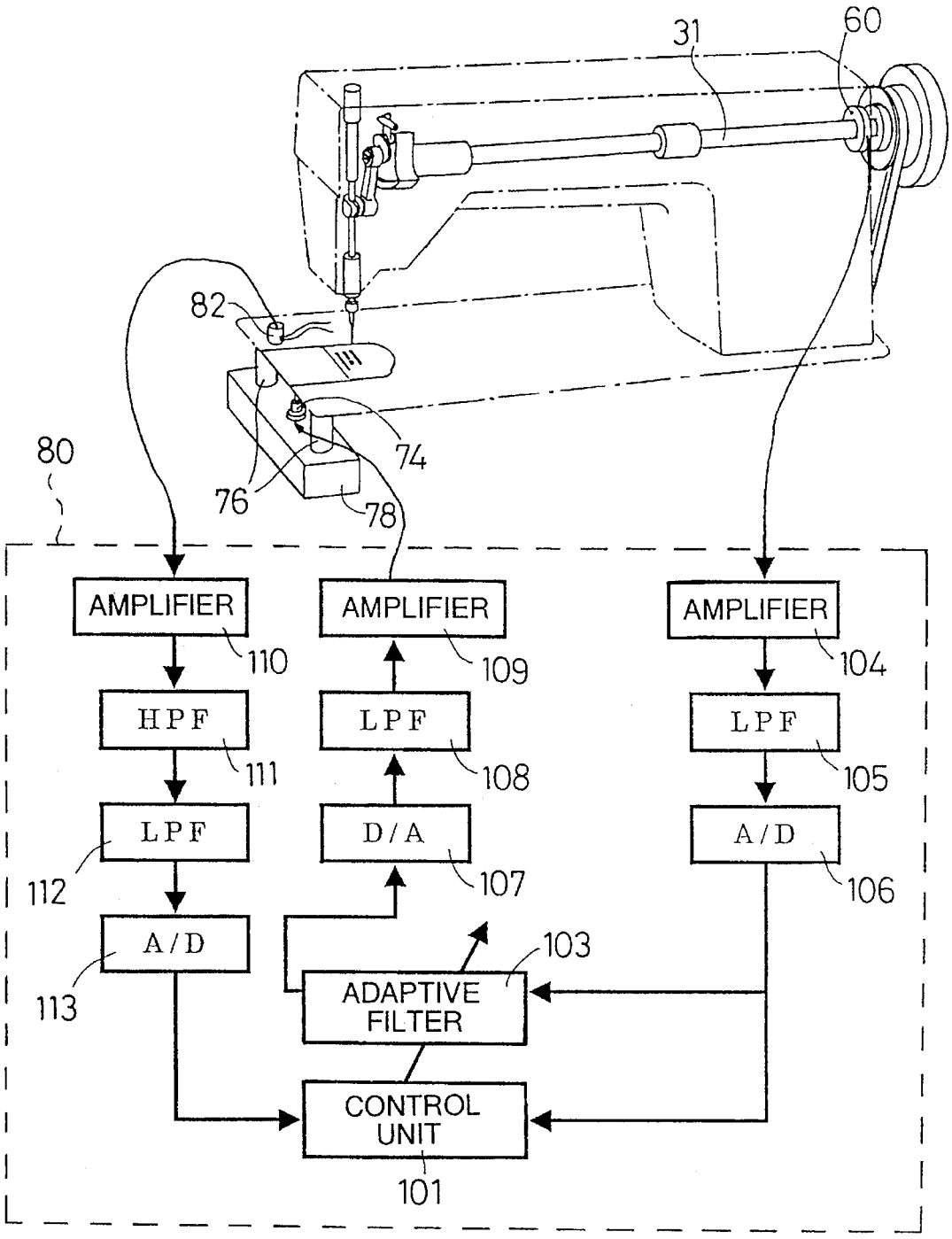
FIG. 3 is a block diagram of a vibration control system contained in a control box of the sewing machine in connection with essential parts of the machine body.

FIG. 3 shows the configuration of the control box 80. The control box 80 is connected to the vibration sensor 82 for detecting residual vibration on the upper surface of the bed 20, the sync signal generating device (the sync signal generating means) 60 for generating a sync signal in synchronism with rotation of the arm shaft 31, and the piezoelectric actuator 74 for generating a control vibration for canceling the vibration generated on the bed 20.

When a sync signal is generated from the sync signal generating device 60, in synchronism with rotation of the arm shaft 31, the sync signal is input through an amplifier 104, a LPF (Low Pass Filter) 105 for removing a high-frequency component, and an A/D converter 106 to both an adaptive filter 103 and a control unit 101. On the other hand, the vibration of the bed 20 is detected by the vibration sensor 82. The detection signal from the vibration sensor 82 is input through an amplifier 110, an HPF (High Pass Filter) 111 for removing a DC component, an LPF 112 for removing a high-frequency component, and an A/D converter 113 to the control unit 101. The control unit 101 determines transfer functions, indicative of the transfer characteristics in a vibration path and characteristics of the electrical parts and the mechanical parts themselves, in consideration of a change in the transfer characteristics due to disturbance in the vibration path and a change in the characteristics of these parts. On the basis of the transfer functions, the control unit 101 determines a transfer function to be applied to the adaptive filter 103 to minimize the detection signal from the vibration sensor 82. The minimized detection signal reflects the interference condition between the vibration generated in the bed 20 and the vibration generated from the piezoelectric actuator 74. Then, the control unit 101 sets a control parameter for specifying the transfer function in the adaptive filter 103. Further, the control unit 101 occasionally corrects the control parameter according to a change of the vibration transfer path and a change in characteristics of the control system.

Accordingly, a sync signal generated by the sync signal generating device 60 is input through the amplifier 104, the LPF 105, and the A/D converter 106 to the adaptive filter 103. The input signal into the adaptive filter 103 is converted into a digital signal having a given amplitude characteristic and a given phase characteristic according to the transfer function applied from the control unit 101 to the adaptive filter 103. The digital signal is converted into an analog signal by a D/A converter 107, filtered by an LPF 108 for removing a high-frequency component, amplified by an amplifier 109, and then applied to the piezoelectric actuator 74 as a driving signal. According to the driving signal thus applied, the piezoelectric actuator 74 generates control vibration for canceling the vibration in the bed 20. As a result, the vibration due to the rotation of the arm shaft 31, the vertical reciprocation of the needle bar 40, and similar movements is attenuated at the location of the vibration sensor 82.

Figure 4:
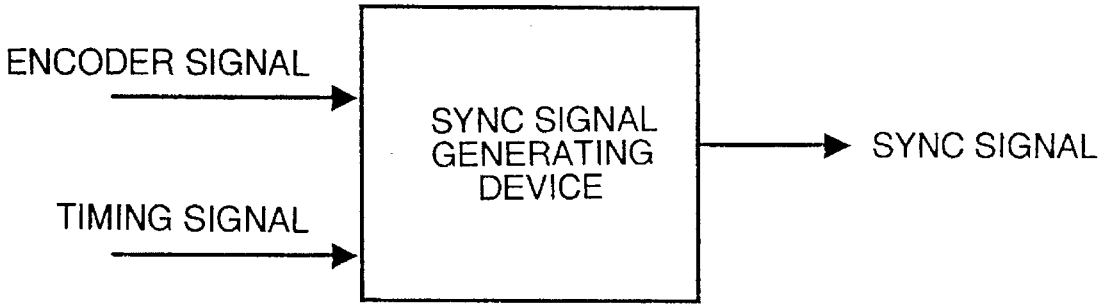
FIG. 4A is a schematic block diagram of a sync signal generating device for generating a sync signal in the first and second preferred embodiments.
FIG. 4B is a timing chart of the sync signal generated from the sync signal generating device shown in FIG. 4A.
Figure 4:
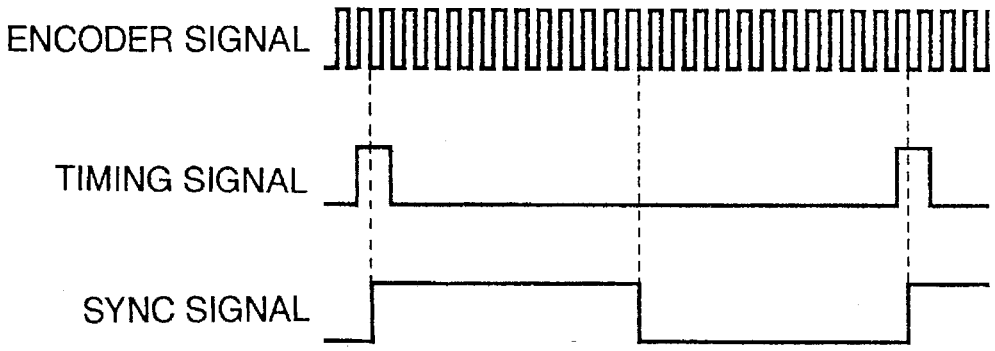

FIGS. 4(A) and 4(B) show the concept of the sync signal generating device 60 for generating a sync signal in synchronism with rotation of the arm shaft 31 as shown in FIG.

3. The fact that the frequency of vibration on the bed 20 is an integral number times the frequency of rotation of the arm shaft 31 is known from the frequency analysis of vibration. From this fact, it is considered that a vibration can be generated in the bed 20 by passing a sync signal synchronized with rotation of the arm shaft 31 through the same transfer system. Accordingly, as shown in FIGS. 4(A) and 4(B), a signal (sync signal) synchronized with rotation of the arm shaft 31 can be obtained as an output from the sync signal generating device 60 by inputting a known encoder signal and a known timing signal. The encoder signal and the timing signal are preset so that twenty-four pulses of the encoder signal and one pulse of the timing signal are output per rotation of the arm shaft 31. When a falling pulse of the encoder signal is detected during ON of the timing signal, the sync signal becomes ON. Thereafter, when the twelfth falling pulse of the encoder signal is detected, the sync signal becomes OFF. Subsequently, this is repeated to output the sync signal synchronized with rotation of the arm shaft 31. Further, a detection error per rotation of the arm shaft 31 is removed by the timing signal.

Figure 5:
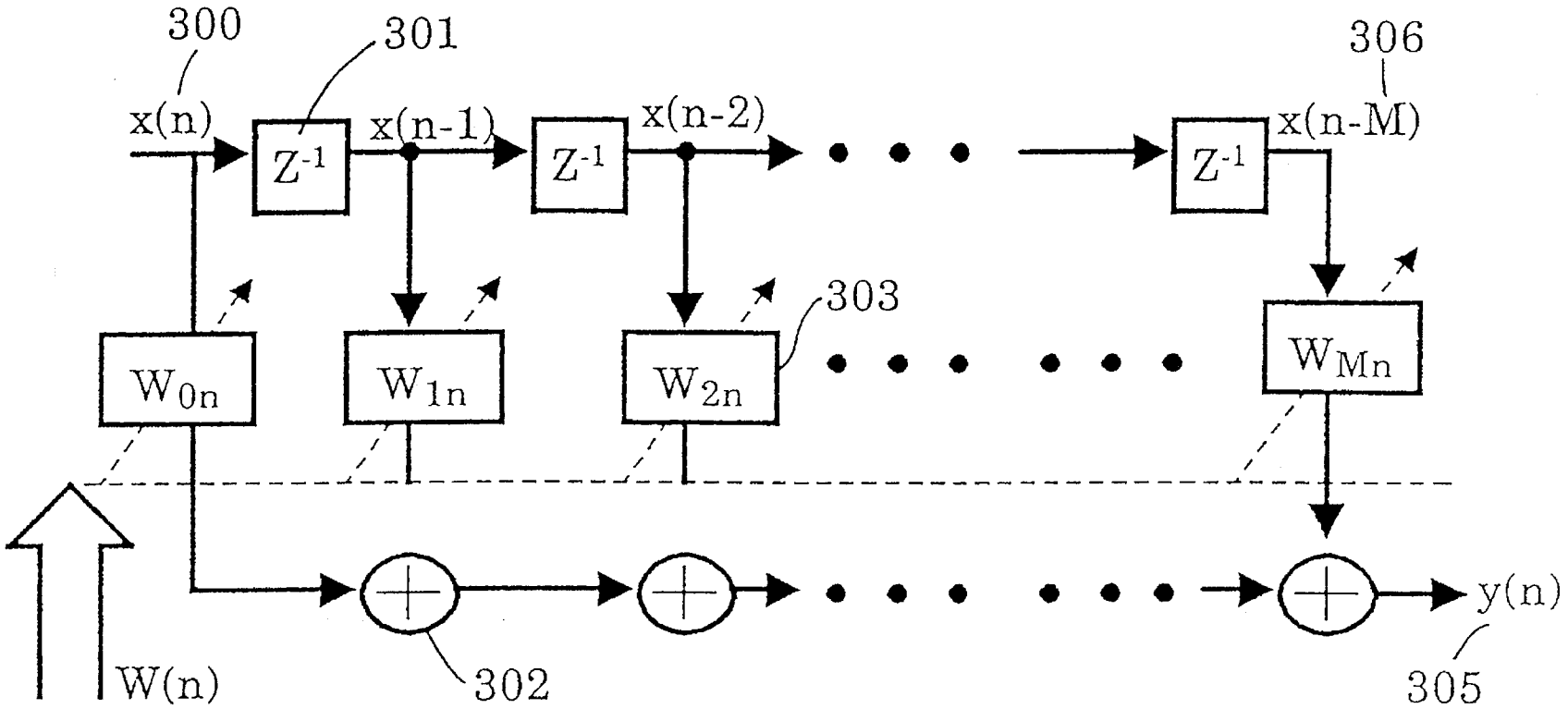
FIG. 5 is a block diagram of an adaptive filter in the first preferred embodiment.

The synthesis of control vibration for driving the piezoelectric actuator 74 from the sync signal synchronized with rotation of the arm shaft 31 can be easily made by providing arbitrary characteristics. For this reason, the adaptive filter 103, shown in FIG. 3, comprises a finite impulse response filter (also called FIR filter) as shown in FIG. 5. An output signal y(n) 305 from the adaptive filter 103 is given by the following equation:

$$y(n)=w0nx(n)+w1nx(n-1)+w2nx(n-2)+\ldots+wMnx(N-M).$$

An input signal x(n) 300 is a sync signal output from the sync signal generating device 60 shown in FIGS. 4(A) and 4(B); reference numeral 301 denotes an unit-delay; reference numeral 303 denotes a variable filter coefficient w0n, w1n, w2n, . . . , wMn occasionally updated in the control unit 101, shown in FIG. 3, and transmitted therefrom; reference numeral 302 denotes an adder; and reference numeral 306 denotes the number of taps of the filter. The use of the variable filter coefficient w1n, w2n, . . . , wMn is intended to track a change in transfer characteristics due to a disturbance in a vibration path and a change in characteristics of the electrical parts and the mechanical parts themselves and to converge the filter coefficient to an optimum filter coefficient.

Figure 6:
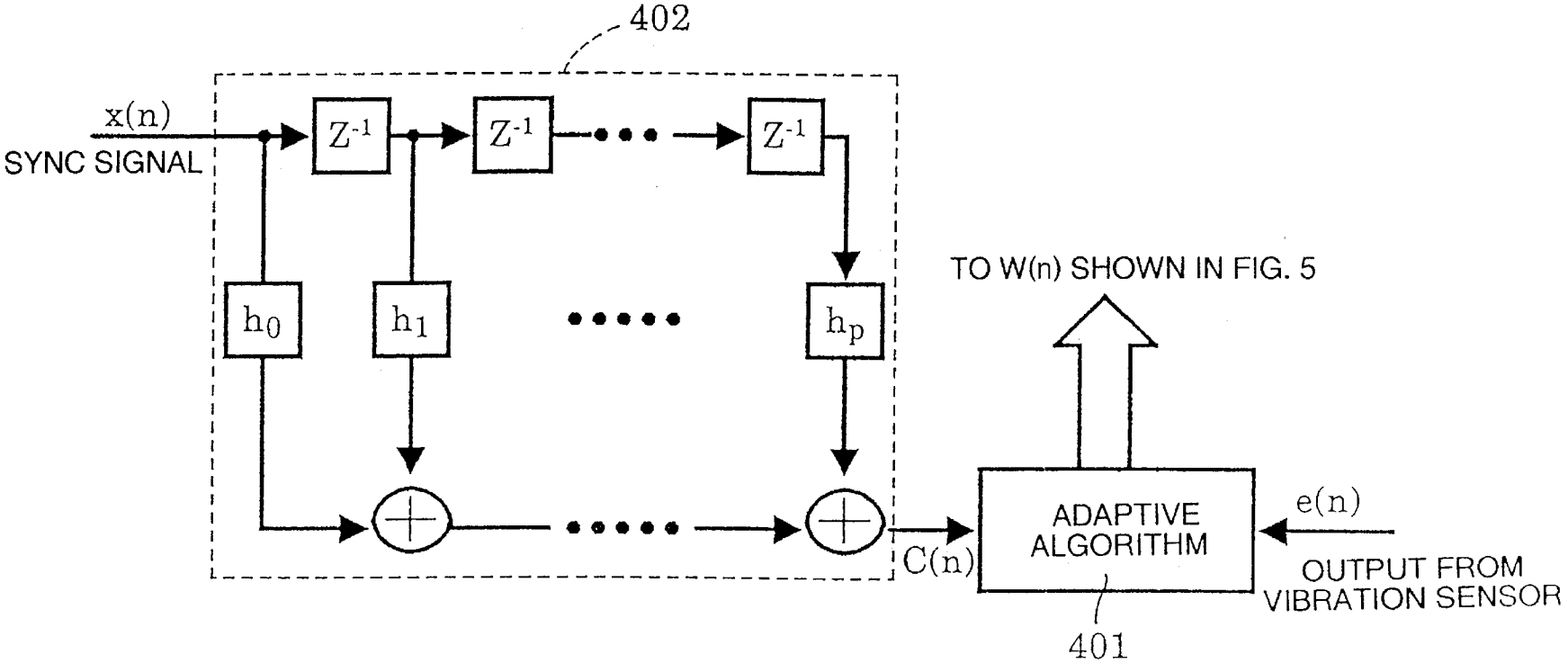
FIG. 6 is a block diagram of a control unit of the vibration control system in the first preferred embodiment.

The control unit 101 is structured as shown in FIG. 6, so as to recursively estimate the variable filter coefficient. In FIG. 6, a reference signal C(n) is generated by passing the sync signal x(n) through a delay filter 402. Both the reference signal C(n) and the detection signal e(n) from the vibration sensor are input into an adaptive algorithm 401 to update the variable filter w1n, w2n, . . . , wMn by using a least mean square (LMS) adaptive algorithm given by the following equation:

$$W(n)=W(n-1)+\mu e(n)C(n)$$

where, $$W(n)=[w1n,\ w2n,\ \ldots,\ wMn]t,$$

$$C(n)=[c(n),\ c(n-1),\ \ldots,\ c(n-M)]t,$$

$$c(n)=h0x(n)+h1x(n-1)+\ldots+hpx(n-p)$$

In the above equation, a parameter μ is a constant called a step size, which is a parameter having an effect on the converging speed and the converging accuracy of the filter coefficient W(n). If the parameter μ is increased, the converging speed (processing speed) is improved, but the converging accuracy is reduced. Conversely, if the parameter μ is decreased, the converging accuracy is improved, but the converging speed is reduced.

The variable filter coefficient w1n, w2n, . . . , wMn thus obtained is transmitted to the adaptive filter shown in FIG. 5, and the output signal y(n) 305 is generated according to the variable filter coefficient. The output signal y(n) 305 is a digital signal that is converted into an analog signal by the D/A converter 107. Then, the analog signal is filtered by the LPF 108, amplified by the amplifier 109, and applied to the piezoelectric actuator 74 as a driving signal. Accordingly, the piezoelectric actuator 74 generates a control vibration for canceling the vibration on the bed 20 due to the rotation of the arm shaft 31.

Figure 7:
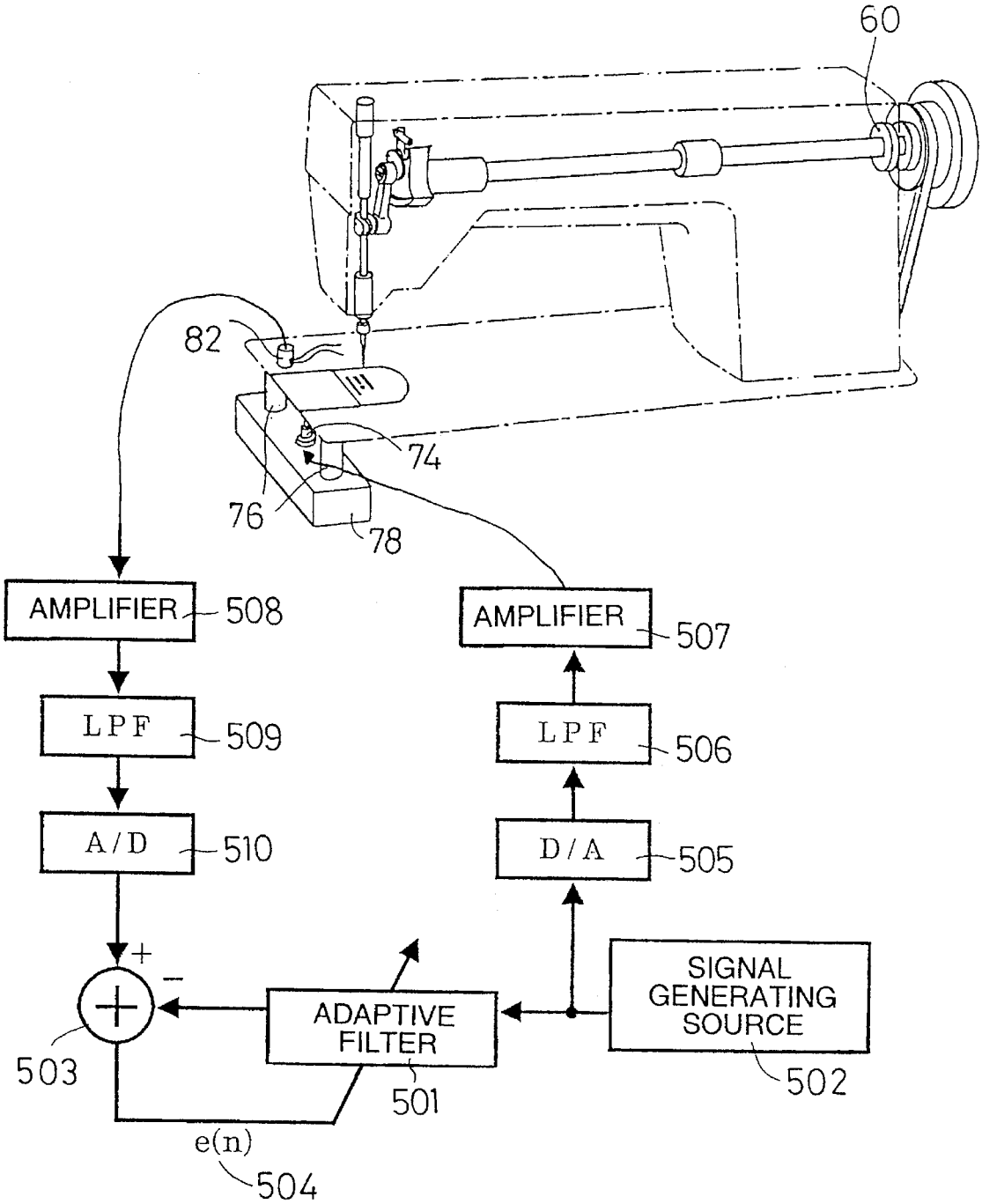
FIG. 7 is a block diagram of a setting sequence for vibration control in the first preferred embodiment in connection with the essential parts of the machine body.

The coefficients h0, h1, . . . , hp of the delay filter 402, shown in FIG. 6, are fixed values which have been previously obtained (See *Adaptive Signal Processing*, B. Widrow and S. Stearns, Prentice-Hall 1985, for a methodology). FIG. 7 shows a setting sequence for obtaining the coefficients h0, h1, . . . , hp of the delay filter 402. This setting sequence is executed prior to generation of the control vibration mentioned above, and is intended to obtain a transfer function from a control actuator including the electrical circuit, the vibration sensor 82, and the piezoelectric actuator 74 to the vibration sensor 82 for reducing vibration. An adaptive filter FIR, using the LMS adaptive algorithm, is mainly used as an adaptive filter 501. A signal generating source 502 generates a periodic signal similar to the vibration of the sewing machine.

The operation of the setting sequence shown in FIG. 7 will now be described. A periodic digital signal, similar to the vibration of the sewing machine, is output from the signal generating source 502. This signal is applied through a D/A converter 505, an LPF 506 for removing a high-frequency component, and an amplifier 507 to the piezoelectric actuator 74, thereby driving the piezoelectric actuator 74 to generate a controlled vibration. On the other hand, the periodic digital signal from the signal generating source 502 is input to the adaptive filter 501 to generate an output. An adder 503 performs addition of a vibration signal detected by the vibration sensor 82 and applied through an amplifier 508, an LPF 509 for removing a high-frequency component, and an A/D converter 510 and the output from the adaptive filter 501, thereby obtaining an error e(n) 504. Then, the adaptive filter 501 recursively corrects the coefficient of the adaptive filter 501 so as to minimize the error e(n) 504. A convergent value of the coefficient is finally used as the filter coefficient h0, h1, . . . , hp shown in FIG. 6.

As described above, the vibration control device for the sewing machine in the first preferred embodiment uses the conventional parts without adding any new parts and without adopting any complex designs. Accordingly, the mechanical strength of the sewing machine is not reduced, and the manufacturing cost of the conventional machine body is retained. In this circumstance, the vibration on the bed due to the rotation of the arm shaft and the vertical reciprocation of the needle bar of the sewing machine can be actively reduced.

While the vibration sensor 82 is shown fixed on a particular position on the bed 20 in this preferred embodiment, it may be movable on the bed 20. In the vibration control device for the sewing machine according to the first preferred embodiment, the single vibration sensor 82 is provided on the bed 20, and the single piezoelectric actuator 74 is provided to suppress vibration on the bed 20 at one position. However, since the bed 20 is not a rigid body, vibration of the bed 20 as a whole is not always reduced by suppressing the vibration on the bed 20 at one position. As a result, the invention also includes a vibration control device for a sewing machine according to a second preferred embodiment to better reduce the vibration of the sewing machine. That is, the vibration control device according to the second preferred embodiment is designed to detect vibrations of the sewing machine at a plurality of positions and to suppress the vibrations simultaneously at the plurality of positions.

The second preferred embodiment will now be described in detail with reference to the drawings. In the second preferred embodiment, two channels of vibration sensors and two channels of piezoelectric actuators are used for convenience in description. However, the only requirement of this embodiment is there be at least two pairs of piezoelectric actuators and sensors. In the following description of the second preferred embodiment, the same parts as those in the first preferred embodiment will be denoted by the same reference numerals and the explanation thereof will be omitted.

Figure 8:
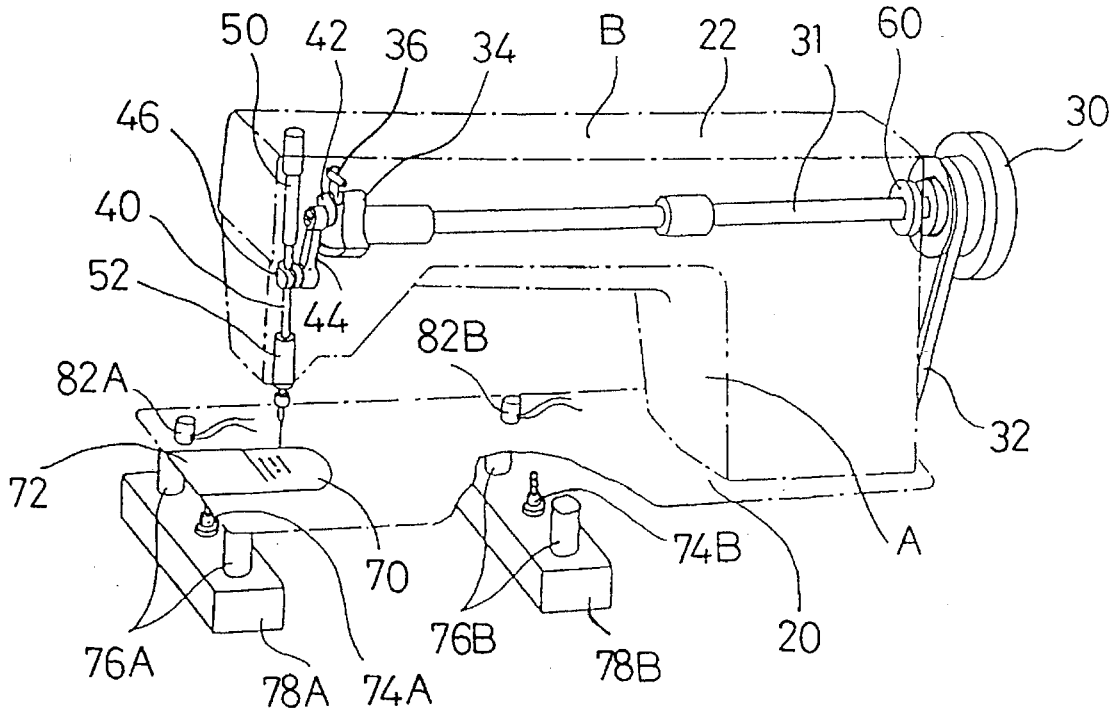
FIG. 8 is a perspective view showing the internal structure of a machine body in the second preferred embodiment.

As shown in FIG. 8, a piezoelectric actuator 74A for generating controlled vibration, a pair of coil springs 76A, and a weight 78A are provided under the left portion of the bed 20. Further, a piezoelectric actuator 74B for generating controlled vibration, a pair of coil springs 76B, and a weight 78B are provided under the central portion of the bed 20. The coil springs 76A are fixed at their upper ends to the lower surface of the bed 20 at two positions, and the coil springs 76B are also fixed at their upper ends to the lower surface of the bed 20 at two positions. The weight 78A is fixed to the lower ends of the coil springs 76A and the weight 78B is fixed to the lower ends of the coil springs 76B. The weights 78A,78B are normally resiliently biased toward the lower surface of the bed 20 by the coil springs 76A,76B, respectively. The piezoelectric actuator 74A is interposed between the lower surface of the bed 20 and the upper surface of the weight 78A under pressure by the tensile forces of the coil springs 76A and the piezoelectric actuator 74B is interposed between the lower surface of the bed 20 and the upper surface of the weight 78B under pressure by the tensile forces of the coil springs 76B. Further, two vibration sensors 82A,82B for detecting residual vibrations are provided on the bed 20 at two positions corresponding to the two piezoelectric actuators 74A,74B, respectively.

Figure 9:
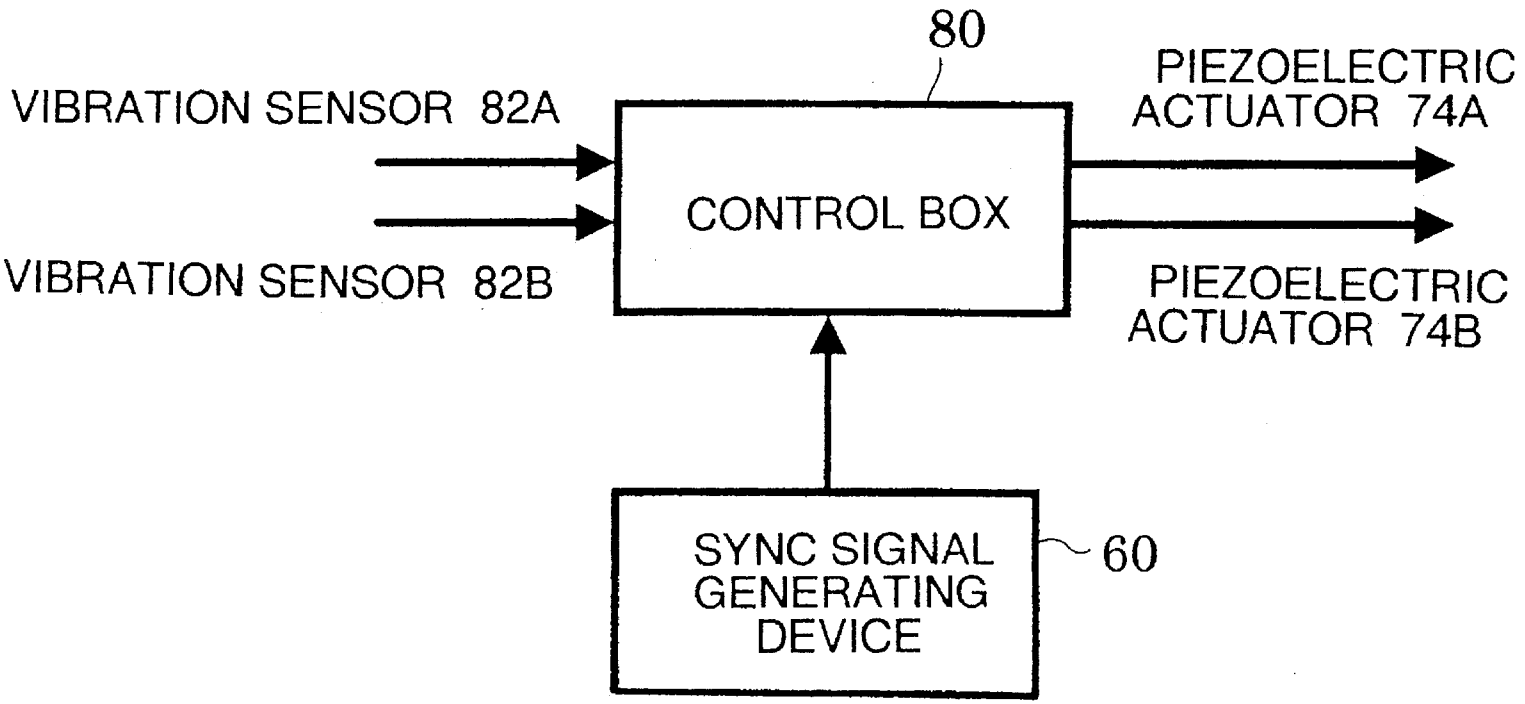
FIG. 9 is a block diagram showing a connected condition of a control box of the sewing machine in the second preferred embodiment.

As shown in FIG. 9, the control box 80, containing the vibration control system for the sewing machine, is connected to the two vibration sensors 82A,82B for detecting residual vibrations on the upper surface of the bed 20, a sync signal generating device 60 for generating a sync signal in synchronism with rotation of an arm shaft 31 of the sewing machine, and the two piezoelectric actuators 74A,74B for generating control vibrations for canceling the vibrations generated on the bed 20. The sync signal is generated and output on the basis of an encoder signal and a timing signal in a manner similar to that of the first preferred embodiment shown in FIGS. 4A, 4B.

Figure 10:
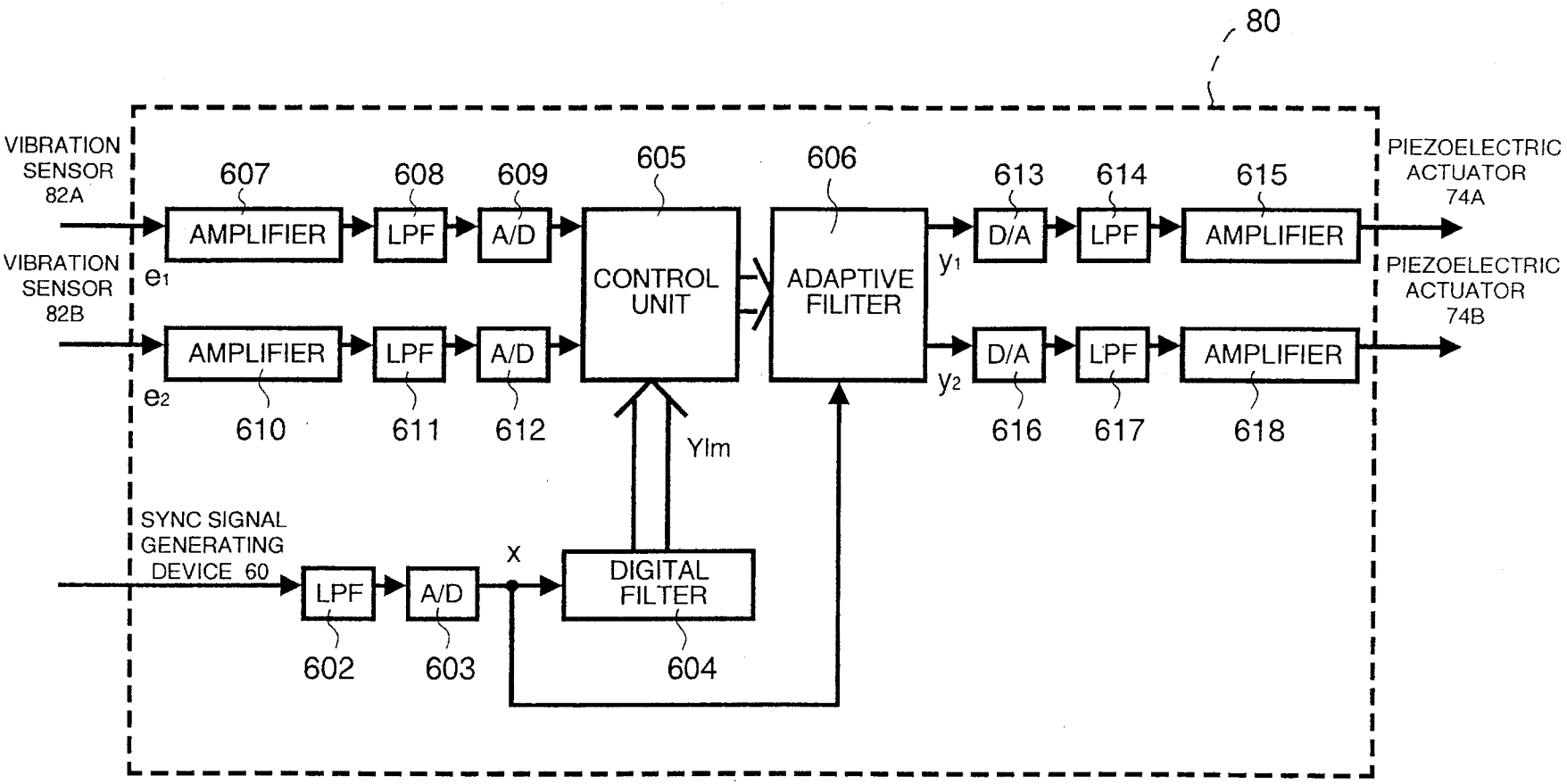
FIG. 10 is a block diagram of a vibration control system contained in the control box in the second preferred embodiment.
Figure 11:
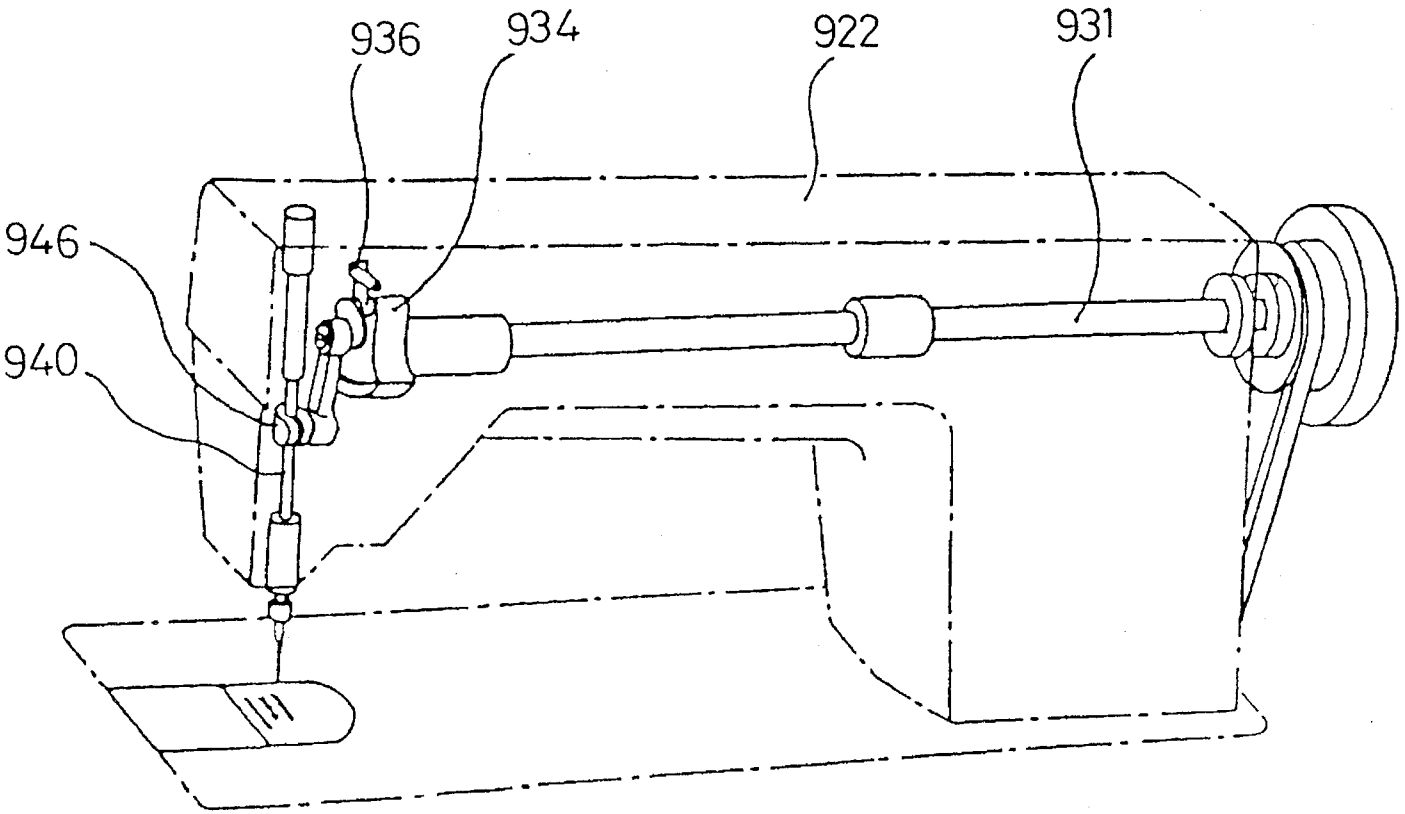
Fig. 11 PRIOR ART
FIG. 11 is a perspective view showing the internal structure of a machine body of a sewing machine in the prior art.

FIG. 10 shows the configuration of the vibration control system contained in the control box 80. A sync signal is generated from the sync signal generating device 60 in synchronism with rotation of the arm shaft 31. The sync signal is filtered by an LPF 602 for removing a high-frequency component and is then converted into a digital signal by an A/D converter 603. Thereafter, the digital signal is input into both an adaptive filter 606 and a digital filter 604. The digital filter 604 generates a reference signal Ylm, in consideration of mutual interference, and inputs it into a control unit 605.

On the other hand, vibrations on the bed 20 are detected by the vibration sensors 82A,82B. Detection signals e1,e2 from the vibration sensors 82A,82B are input through amplifiers 607,610, LPFs 608,611 for removing high-frequency components, and A/D converters 609,612 for converting analog signals into digital signals, respectively, into the control unit 605. The control unit 605 adjusts the coefficients of the adaptive filter 606 in consideration of a change in transfer characteristics due to disturbance in a vibration path, a change in characteristics of the electrical parts and the mechanical parts, and the mutual interference to transmit a specific transfer function to the adaptive filter 606. More specifically, the control unit 605 determines a transfer function to be applied to the two-channel adaptive filter 606 so as to simultaneously minimize the detection signals from the vibration sensors 82A,82B for detecting an interference condition between the vibrations generated on the bed 20 and the control vibrations to be generated from the piezoelectric actuators 74A,74B, and sets a control parameter for specifying the transfer function in the two-channel adaptive filter 606. Further, the control unit 605 always performs correction of the control parameter according to a change in the vibration transfer path and a change in the characteristics of the control system.

Accordingly, a sync signal detected by the sync signal generating device 60 is input through the LPF 602 and the A/D converter 603 into the adaptive filter 606. The input signal into the adaptive filter 606 is converted into a digital signal having a given amplitude characteristic and a given phase characteristic according to the transfer function applied from the control unit 605 to the two-channel adaptive filter 606. The digital signals $Y_1$,$Y_2$ in the two channels of the adaptive filter 606 are converted into analog signals by D/A converters 613,616, filtered by LPFs 614,617 for removing high-frequency components, amplified by amplifiers 615,618, and then applied to the piezoelectric actuators 74A,74B as driving signals. The piezoelectric actuators 74A,74B having received the driving signals generate control vibrations for canceling the vibrations on the bed 20. As a result, the vibrations due to rotation of the arm shaft 31, vertical reciprocation of the needle bar 40, and similar movements can be attenuated at the locations of the vibration sensors 82A,82B.

The synthesis of control vibrations for driving the piezoelectric actuators 74A,74B from the sync signal synchronized with rotation of the arm shaft 31 can be easily made by providing arbitrary characteristics. For this reason, the two-channel adaptive filter 606, shown in FIG. 10, is constructed by a finite impulse response filter (also called FIR filter).

A process for vibration control in the control unit 605 will now be described.

Let el(n) denote a vibration signal detected by an 1-th vibration sensor 821, dl(n) denote a vibration signal detected by the 1-th vibration sensor 821 when no control vibration is generated from the piezoelectric actuators, clmj denote a j-th term of a transfer function clm between an m-th piezoelectric actuator 74*m* and the 1-th vibration sensor 821, x(n) denote a sync signal, and Wmi denote an i-th coefficient of a filter of each output channel in the adaptive filter 606 for inputting the sync signal x(n) and driving the m-th piezoelectric actuator 74*m*. In these conditions, the following equation is given:

$$e_{l(n)} = d_{l(n)} - \sum_{m=1}^{M} \sum_{j=0}^{J-1} C_{lmj} \left( \sum_{i=0}^{I-1} W_{mi} X_{(n-j-i)} \right) \quad \text{Eq. 1}$$

where each term suffixed by (n) represents a sampled value at a sampling time n; L represents the number of vibration sensors (two in the second preferred embodiment); M represents the number of piezoelectric actuators (two in the second preferred embodiment); I represents the number of taps of the transfer function clm represented in the FIR digital filter; and J represents the number of taps of the adaptive filter 606.

In Eq. 1, the term enclosed by the parenthesis in the right side represents an output when a sync signal is input into the filter (whose coefficient is represented by Wm) of each output channel in the adaptive filter 606; the term expressed by multiplying the transfer function by the term enclosed by the parenthesis in the right side represents a signal when signal energy input into the m-th piezoelectric actuator 74*m* is output as vibration energy from the m-th piezoelectric actuator 74*m*, and is then transmitted through the vibration transfer function clm on the bed 20 to the 1-th vibration sensor 821; and the whole term subsequent to the sign "–" in the right side represents the sum of the signals from all the piezoelectric actuators to the 1-th vibration sensor 821, i.e., the sum of secondary vibrations reaching the 1-th vibration sensor 821.

Then, a performance function Je is given as follows:

$$J_e = \sum_{l=1}^{L} \{e_{1(n)}\}^2 \quad \text{Eq. 2}$$

To obtain a filter coefficient Wm minimizing the performance function Je, an LMS adaptive algorithm is used in the second preferred embodiment. That is, the performance function Je (Eq. 2) is approximated to an instantaneous gradient value (Eq. 3) for each filter coefficient Wmi, and each filter coefficient Wmi is updated by the instantaneous gradient value.

That is, Eq. 3 is obtained from Eq. 2:

$$(\nabla J_e) W_{mi} = \sum_{j=0}^{J-1} 2e_{1(n)} (\nabla e_{1(n)}) W_{mi} \quad \text{Eq. 3}$$

Further, Eq. 4 is obtained from Eq. 1:

$$(\nabla e_{1(n)}) W_{mi} = -\sum_{l=1}^{L} C_{lmj} X_{(n-j-i)} = -\gamma_{lm}(n-i). \quad \text{Eq. 4}$$

By substituting rlm(n–i) for the right side of Eq. 4, the filter coefficient is expressed by Eq. 5:

$$\begin{aligned} W_{mi}(n+1) &= W_{mi}(n) - \mu(\nabla J_e) W_{mi} \\ &= W_{mi}(n) + 2\mu \sum_{l=1}^{L} e_{l(n)} \gamma_{lm}(n-i) \end{aligned}$$

where μ represents a constant called a step size, which is a parameter having an effect on the converging speed and the converging accuracy of the adaptive filter. If the parameter μ is increased, the converging speed (processing speed) is improved, but the converging accuracy is reduced. Conversely, if the parameter μ is decreased, the converging accuracy is improved, but the converging speed is reduced.

The filter coefficient w1n, w2n, . . . , wMn obtained above is transmitted to the adaptive filter 606 to generate output digital signals y1(n) and y2(n). The output digital signals y1(n) and y2(n) are converted into analog signals by the D/A converters 613,616, filtered by the LPFs 614,617, amplified by the amplifiers 615,617, and then applied to the piezoelectric actuators 74A,74B as driving signals. Then, the piezoelectric actuators 74A,74B having received the driving signals, generate control vibrations for canceling the vibrations on the bed 20 due to rotation of the arm shaft 31 and similar vibration including movements.

The coefficient clmj of the digital filter 604, shown in FIG. 10, is previously obtained, so as to obtain mutual transfer functions from control actuators including the electrical circuits, the vibration sensors 82A,82B, and the piezoelectric actuators 74A,74B to the vibration sensors 82A,82B for reducing vibrations. The digital filter 604 is mainly FIR filter.

The operation of the second preferred embodiment will now be described. When the motor 18 is started, an encoder signal and a timing signal are input into the sync signal generating device 60, which in turn outputs a sync signal x. The sync signal x is supplied to the vibration control system contained in the control box 80.

In the vibration control system, the sync signal x is supplied through the LPF 602, the A/D converter 603 to the digital filter 604 and the adaptive filter 606. The digital filter 604 uses the input sync signal x to compute a sync signal rlm according to the transfer function clm between each of the vibration sensors 82A,82B and each of the piezoelectric actuators 74A,74B on the basis of Eq. 4 and then outputs the sync signal rlm to the control unit 605.

On the other hand, the vibration sensors 82A,82B detect residual vibrations at their locations and output error signals e1,e2 corresponding to the residual vibrations to the vibration control system in the control box 80. In the vibration control system, the input error signals e1,e2 are transmitted through the amplifiers 607,610, the LPFs 608,611, and the A/D converters 609,612, respectively to the control unit 605.

In the control unit 605, a computation for updating a filter coefficient is performed on the basis of Eq. 5 by using each input signal. That is, a filter coefficient Wmi(n) at a present sampling time n is updated so that the performance function Je, i.e., the mean square of the error signals el(n) corresponding to the residual vibrations from the vibration sensors 82A,82B is minimized to obtain a filter coefficient Wmi(n+1) to be set at a sampling time (n+1). Then, the control unit 605 outputs a control signal according to the computed value Wmi(n+1) to the adaptive filter 606. Accordingly, the coefficient of each filter in the adaptive filter 606 is updated to the newly computed filter coefficient Wmi at the sampling time (n+1). In this way, the filter coefficient is repeatedly updated at regular sampling intervals so as to minimize the performance function Je in the control unit 605.

Each filter in the adaptive filter 606 performs a vector operation on the input sync signal x and the filter coefficient Wmi set at a certain time to obtain the output values y1,y2, which are in turn supplied as driving signals through the D/A converters 613,616, the LPFs 614,617, and the amplifiers 615,618 to the piezoelectric actuators 74A,74B, respectively.

Accordingly, the piezoelectric actuators 74A,74B generate control vibrations according to the input signals y1,y2, so that each vibration output thus generated is propagated in the bed 20 corresponding to the preliminarily estimated transfer function clm to form a vibration. As a result, after convergence of control, the vibrations in local areas on the bed 20 where the vibration sensors 82A,82B are located are almost canceled by the controlled vibrations to thereby greatly reduce the residual vibrations. Even when the vibrations are changed by rotation of the motor 18, this change is reliably tracked by the sync signal x and detected so that the vibrations can be reliably reduced.

Although the vibration sensors 82A,82B are shown fixed on the bed 20 in the second preferred embodiment, they may be movable on the bed 20. Further, although the two vibration sensors 82A,82B and the two piezoelectric actuators 74A,74B are provided in the second preferred embodiment, the numbers of the vibration sensors and the piezoelectric actuators are not limited to the above. For example, three vibration sensors and three piezoelectric actuators may be provided.

What is claimed is:

1. A sewing machine having a vibration control device machine, comprising:

sync signal generating means for generating a sync signal in synchronism with rotation of an arm shaft of said sewing machine;

vibration detecting means for detecting vibration generated on a machine body of said sewing machine;

control vibration generating means capable of generating control vibration for canceling the vibration generated on said machine body;

transfer function setting means for preliminarily setting a transfer function indicative of characteristics of mechanical parts and electrical parts of said sewing machine; and vibration control means for controlling said control vibration generating means so as to minimize the vibration detected by said vibration detecting means according to the sync signal generated from said sync signal generating means, the transfer function set by said transfer function setting means, and a detection signal from said vibration detecting means.

2. The sewing machine according to claim 1, wherein said vibration detecting means comprises a plurality of vibration detecting means for simultaneously detecting vibrations generated at a plurality of positions on said machine body, said control vibration generating means comprises a plurality of control vibration generating means for generating control vibrations for simultaneously canceling the vibrations generated at said plurality of positions on said machine body, and said vibration control means controls said plurality of control vibration generating means so as to simultaneously minimize the vibrations detected by said plurality of vibration detecting means.

3. The sewing machine according to claim 2, wherein said vibration detecting means and said control vibration generating means are provided on a bed of said machine body.

4. The sewing machine according to claim 3, wherein said vibration detecting means is supported on an upper surface of said bed, and said control vibration generating means is interposed under pressure between a lower surface of said bed and a weight resiliently biased toward said lower surface of said bed.

5. The sewing machine according to claim 1, wherein said vibration detecting means comprises a plurality of vibration detecting means for simultaneously detecting vibrations generated at a plurality of positions on said machine body.

6. The sewing machine according to claim 1, wherein said control vibration generating means comprises a plurality of control vibration generating means for generating control vibrations for simultaneously canceling the vibrations generated at the plurality of positions on said machine body.

7. A sewing machine having a body with a sewing bed, an arm with a rotating arm shaft and a reciprocating needle bar mounted in the arm and a vibration control device, comprising:

a sync signal generating means for outputting a sync signal synchronized with rotation of the rotating arm shaft;

at least one vibration detection device mounted to the body for detecting vibration therein;

at least one counter-vibration actuator mounted to the body; and control means for controlling activation of said counter-vibration actuator based upon the output of said sync signal generating means and output from said vibration detection device.

8. The sewing machine according to claim 7, further comprising transfer function setting means for preliminarily setting a transfer function indicative of characteristics of mechanical parts and electrical parts of the sewing machine.

9. The sewing machine as claimed in claim 8, further comprising compensation means for providing an adjustment factor to be applied to said at least one counter-vibration actuator.

10. The sewing machine as claimed in claim 8, wherein there are at least two said vibration detection devices and said counter-vibration activators.

11. The sewing machine as claimed in claim 8, wherein at least one vibration detection device has a fixed position on the sewing bed.

12. The sewing machine as claimed in claim 8, wherein said at least one vibration detection device can be positioned at any position on the sewing bed.

13. The sewing machine as claimed in claim 8, wherein said counter-vibration actuator mounted to the sewing bed comprises:

a weight suspended from the sewing bed;

resilient suspension means between the sewing bed and said weight for suspending said weight; and an actuator between said weight and the sewing bed.

14. The sewing machine as claimed in claim 13, wherein said resilient suspension means comprises a pair of springs, a spring of said pair of springs mounted to said weight so as to be separated from one another and evenly draw said weight toward the sewing bed.

15. The sewing machine as claimed in claim 14, wherein said counter-vibration actuator is positioned mid-way between said springs.

16. The sewing machine as claimed in claim 14, wherein said counter-vibration actuator is a piezoelectric actuator.

17. The sewing machine as claimed in claim 15, wherein said control means actuates said counter-vibration actuator based upon vibration input from said vibration detection device.

18. The sewing machine according to claim 8, wherein said at least one vibration detection device comprises a plurality of vibration detection devices for simultaneously detecting vibrations generated at a plurality of positions on said body.

19. The sewing machine according to claim 8, wherein said counter-vibration actuator comprises a plurality of counter-vibration actuators for generating control vibrations for simultaneously canceling the vibrations generated at said plurality of positions on said body.

20. The sewing machine according to claim 8, wherein a counter-vibration actuator is paired with a vibration detection device to form a vibration suppression pair.

* * * * *

UNITED STATES PATENT AND TRADEMARK OFFICE

CERTIFICATE OF CORRECTION

PATENT NO. : 5,551,360
DATED : September 3, 1996
INVENTOR(S) : Zhongqi QIU

It is certified that error appears in the above-indentified patent and that said Letters Patent is hereby corrected as shown below:

ON THE TITLE PAGE:

Line [75] Inventor: please change "Qui" to --Qiu--.

Signed and Sealed this

Twenty-fifth Day of November, 1997

*Attest:*

BRUCE LEHMAN

*Attesting Officer*

*Commissioner of Patents and Trademarks*